United States Patent [19]

Agren

[11] Patent Number: 5,025,498

[45] Date of Patent: Jun. 18, 1991

[54] APPARATUS FOR CONTROLLING THE TRIGGER SEQUENCE IN IGNITION SYSTEMS

[75] Inventor: Nils A. Agren, Åmål, Sweden

[73] Assignee: SEM AB, Amal, Sweden

[21] Appl. No.: 388,299

[22] Filed: Jul. 27, 1989

Related U.S. Application Data

[63] Continuation of Ser. No. 25,402, Mar. 13, 1987, abandoned.

[30] Foreign Application Priority Data

Mar. 14, 1986 [SE] Sweden ..... 8601219

[51] Int. Cl.[5] ..... H01H 47/00

[52] U.S. Cl. ..... 361/156; 361/256; 123/602

[58] Field of Search ..... 361/156, 256; 123/599, 123/601-603, 605; 307/599; 315/209 CD, 209 SC

[56] References Cited

U.S. PATENT DOCUMENTS

| | | | |
|---|---|---|---|
| 3,508,116 | 4/1970 | Burson | 361/256 |
| 3,809,043 | 5/1974 | Nagasawa | 123/599 |
| 4,399,801 | 8/1983 | Kondo | 123/603 |
| 4,566,425 | 1/1986 | Nitou et al. | 123/603 |

FOREIGN PATENT DOCUMENTS

| | | | |
|---|---|---|---|
| 2362472 | 6/1975 | Fed. Rep. of Germany | 123/599 |
| 2751213 | 12/1979 | Fed. Rep. of Germany . | |
| 2920486 | 3/1980 | Fed. Rep. of Germany . | |
| 2851097 | 12/1980 | Fed. Rep. of Germany . | |
| 2369434 | 6/1978 | France | 123/599 |
| 8504332 | 2/1975 | Sweden . | |
| 8205402 | 1/1979 | Sweden . | |

*Primary Examiner*—L. T. Hix
*Assistant Examiner*—David M. Gray
*Attorney, Agent, or Firm*—Collard, Roe & Galgano

[57] ABSTRACT

The invention relates to an apparatus for controlling the triggering sequence in capacitive ignition systems for internal combustion engines. The induction achieved by a flywheel magneto usually results in three voltage wave halves, of which two (A,B) have one polarity and an intermediate one (C) has an opposite polarity. In the present case, the first voltage halfwave (A) is used for triggering voltage and the subsequent halfwave with opposite polarity (C) for the charging voltage. The subsequent last voltage halfwave is suppressed (B″) to a level below the triggering level. This is achieved by arranging an inhibiting circuit (11-15) for the conventional triggering circuit (8,9,10) by charging (11) a further capacitor (12) during the charging phase itself, the capacitor (12) maintaining control voltage for a further thyristor (15) or triac, which is arranged to short-circuit the triggering voltage.

1 Claim, 2 Drawing Sheets

APPARATUS FOR CONTROLLING THE TRIGGER SEQUENCE IN IGNITION SYSTEMS

This is a continuation of prior copending application Ser. No. 07/025,402, filed Mar. 13, 1987 (now abandoned).

TECHNICAL FIELD

Capacitive ignition systems are frequently used today, particularly in small internal combustion engines, where the necessary ignition power is generated by a flywheel magneto. Using modern technology the systems can be produced with small dimensions and be readily adapted to relatively high engine rpm. Recently, however, greater and greater demands are made on both engine rpm and a functionally suitable ignition curve. There is often a desire also to achieve effective rpm limitation with simple means without otherwise affecting the ignition function.

In order that the present invention shall be more easily understood, it is suitable herebelow to summarily account for the technical problems occurring in so-called capacitive ignition systems. The FIGS. 1–4 are referred to in connection herewith, these Figures relating to prior art.

LIST OF FIGURES

Figure 1:
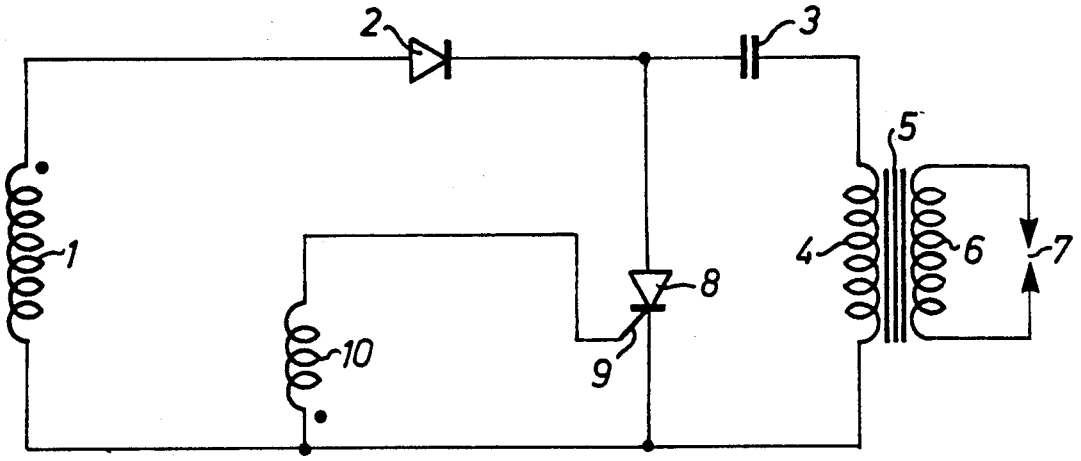
FIG. 1 is a simplified diagram of a capacitive ignition circuit.

The ignition circuit illustrated in FIG. 1 comprises a charge winding 1 arranged on a not more closely illustrated core in coaction with a flywheel magneto. The charge winding 1 is connected to a diode 2, which in turn is connected in series with a capacitor 3, the primary winding 4 of an ignition transformer 5 being also part of the series circuit, the secondary winding of the transformer 5 being in communication with the gap 7 of a spark plug. The charge winding 1 diode 2, capacitor 3 and winding 4 thus form a series circuit. A thyristor 8 or triac is connected between the diode 2 and capacitor 3 so that a further series circuit can be established, this circuit comprising the capacitor 3, the thyristor 8 and the primary winding 4. The control electrode 9 of the thyristor 8 is connected to a trigger winding 10, which is also mounted on the core coacting with the flywheel magneto.

Figure 2:
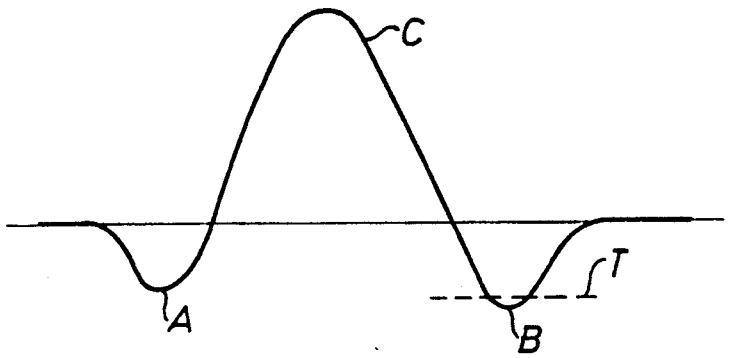
FIG. 2 illustrates a type of voltage waveform generated in a circuit according to FIG. 1.

It is assumed that during the rotation the flywheel magneto there is generated across core 1, coil 4 and coil 10 in the circuit a voltage sequence, which with unloaded windings 1, 4 and 10, has a curve configuration that will be seen from FIG. 2. The first and last voltage halfwaves A and B, respectively, have the same polarity while the intermediate voltage halfwave C has opposite polarity It is usual that the windings 1 and 10 are wound on the core such that they induce opposite voltages. If the windings are connected according to the diagram of FIG. 1, the situation during an induction sequence will be that the first voltage halfwave A actuates the trigger function of the thyristor 8, but the threshold value is adjusted so that it normally cannot cause the thyristor to open during this half period. During the subsequent half period the thyristor 8 is thus non-conductive, while a charge voltage is generated in the charge winding 1, this voltage being taken to the capacitor 3 via the diode 2 for charging the capacitor. The charge current also flows through the primary winding 4, of course, but the induction sequence is here too slow for enabling the initiation of any spark at the spark gap 7. When the capacitor 3 is fully charged, i.e. when the peak of the voltage halfwave C is arrived at, the voltage falls and the polarity is changed by induction so that the voltage halfwave B is generated. This will reach a level T, as illustrated by a dashed line, at which the thyristor 8 becomes conductive and switches the capacitor 3 to the primary winding so that a voltage is induced in the secondary winding 6, due to the current surge shock, resulting in a spark at the spark gap 7.

Figure 3:
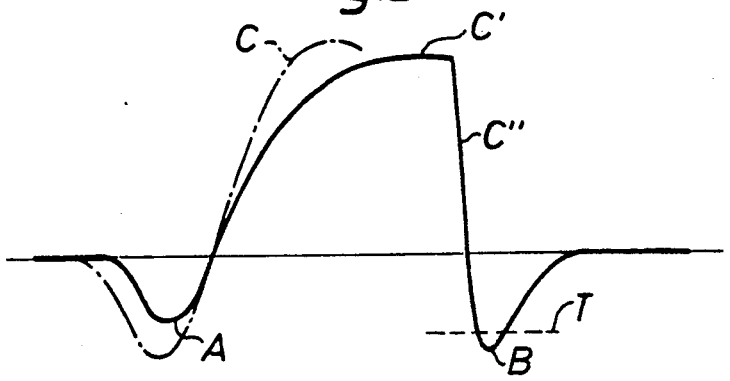
FIG. 3 depicts a curve applying to an operational state.

The voltage sequence during operation in the manner described above is not so ideal as is seen from FIG. 2, however. The curve configuration occurring is illustrated in FIG. 3. When a charge sequence is built up, the charge winding 1 will naturally be loaded, and this results in a lagging effect where the peak, now denoted C', is now achieved until after a somewhat longer time than during idling. This results in that, when the voltage begins to decrease after charging the capacitor, a very rapid return to zero voltage takes place, as will be seen from the steep curve flank C'' in FIG. 3. The growing trigger voltage B of opposite polarity triggers the thyristor as already described.

An ignition advance timing must be provided for increasing rpm in order that the engine ignition curve shall be as straight as possible and adapted to the engine function. Such ignition advance timing is most often achieved by the growth in curve width obtained with increasing engine rpm, i.e. increased voltage generation. As will be seen from FIG. 3, the steep flank C'' will retard the widening of curve B in the direction of ignition advance timing, to the left on the curve. The greater the rpm the greater will be the lag on charging the capacitor and the steeper will be the curve flank C''. An undesired ignition advance timing curve is thus obtained for high engine rpm. Retardation is thus obtained.

Figure 4:
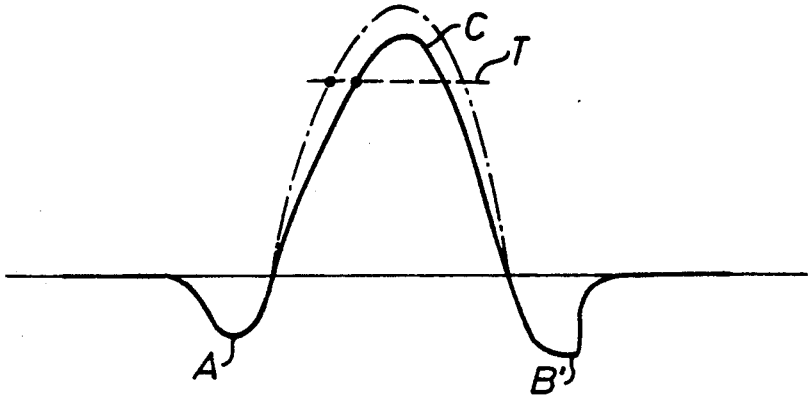
FIG. 4 depicts a curve applying to another kind of operational state.

It has been attempted to solve the problem in question by using the curve part C for the triggering function and the curve part A or B for charging, see FIG. 4. The disadvantage with such an arrangement is that there is poor charging of the capacitor for low engine rpm, due to the potential halfwave A or B seldom reaching particularly high values. In such an implementation the triggering function is, however, fairly unaffected, and the growth which takes place in the curve C with increasing rpm naturally contributes effectively to moving the ignition time forward, as will be seen by the dashed curve. However, the potential halfwave B will be given a changed appearance relative B', due to its now serving as energy supplier for charging the capacitor. As will be seen, the sequence is similar to the one for the curve parts C',C'' in FIG. 3. Even if charging the capacitor is obtained at B', the charge voltage will often not be satisfactory. It is therefore more attractive to utilize the apparatus so that the charge takes place during the curve part C, i.e. as illustrated in FIG. 3.

THE PRESENT INVENTION

The invention is based on the use of a circuit essentially the same as in FIG. 1, and described above in connection with capacitive ignition apparatus, where the greatest flux change is used, namely the one represented by the voltage halfwave C, as the charge phase. However, to provide ignition advance with increasing rpm, i.e. to avoid the effect of the steep flank C″ in FIG. 3, the circuit is arranged so that the curve part B is substantially suppressed after the capacitor has been charged, triggering then taking place at the curve part A. There is thus achieved the advantage that ignition timing is easily attained since the curve A is unaffected from the aspect of its growth. To achieve the suppression of the curve part B, it is arranged in accordance with the invention to inhibit the triggering function during the time corresponding to curve B.

The distinguishing features of the present invention are disclosed in the following claims.

The invention will b described in detail with reference to an embodiment illustrated in FIGS. 5 and 6 on the accompany in drawing.

Figure 5:
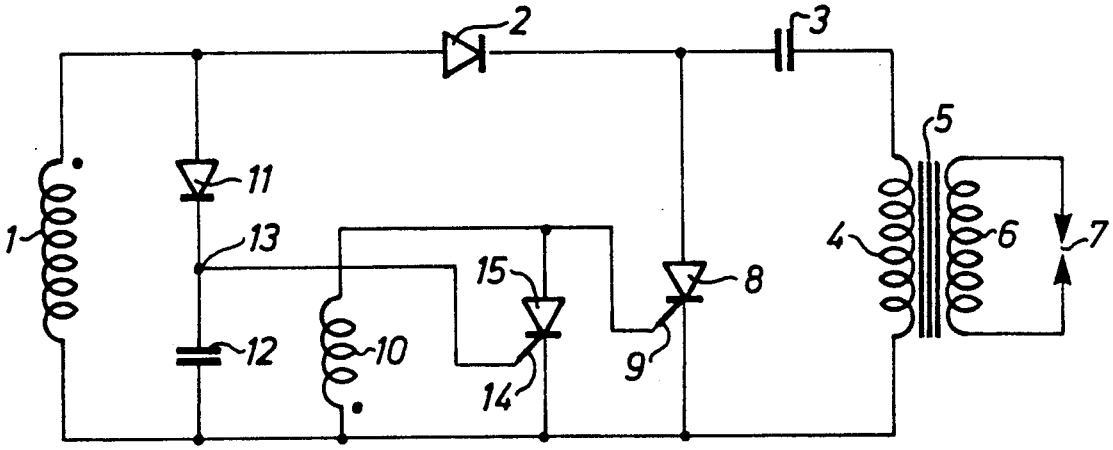
FIG. 5 is a circuit diagram of the instant invention.

The components in FIG. 5 corresponding to those in FIG. 1 have the same denotations.

As will be seen, the ignition circuit itself is built up in agreement with what is shown in FIG. 1, except that the following circuits have been added: A series circuit comprising a diode 11 and a capacitor 12 is connected across the charge winding 1. A terminal 13 between the diode 11 and capacitor 12 is connected to the control electrode 14 in a further thyristor 15 or triac. The thyristor 15 in turn is connected across the triggering coil 10. The apparatus functions in the following manner.

During the charging phase, i.e. when current flows from the charge winding 1 through the diode 2 and capacitor 3 for charging the latter, there is also a current flow through the diode 11 so that the capacitor 12 is charged. The voltage now occurring across the capacitor 12 is taken to the control electrode 14 in the thyristor 15. The thyristor 15 is then caused to take up a conductive state (when voltage is put across it). During the phase now described, the capacitor 3 is also charged to full operational potential. When the voltage drops once again and finally changes its polarity, a triggering voltage is induced in the trigger winding 10. However, this triggering voltage does not attain triggering level, due to the thyristor 15 acting substantially as a short circuit, and consequently no triggering voltage is obtained on the control electrode 9 of the thyristor 8. It will be seen from FIG. 6 how this is expressed in the curves, where after the steep flank C″ of the charging phase, the curve B now has a very much shrunken sequence B″, lying well below the triggering voltage level T. The flywheel magneto once again turns a revolution, the subsequent potential sequence begins to be induced, the voltage halfwave A first arising. This is now used as triggering voltage, since the voltage on the capacitor 12 has ceased meanwhile and consequently the thyristor 15 has become non-conductive. In the triggering instant now arising the thyristor 8 will be conductive and a spark is triggered at the gap 7.

Figure 6:
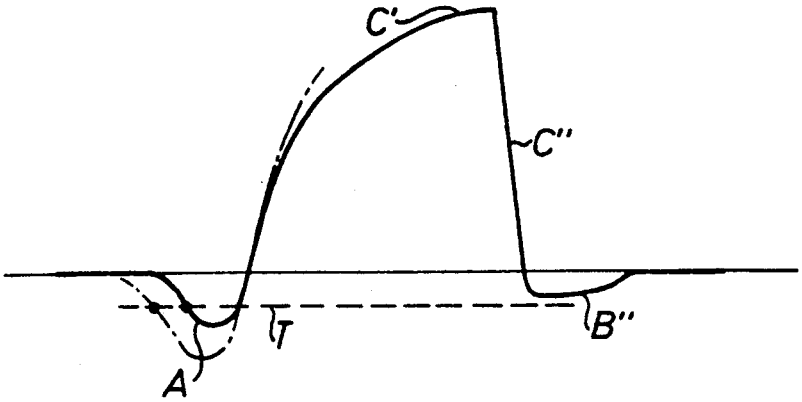
FIG. 6 is the voltage curve sequence during an operational state for the apparatus according to FIG. 5.

As will be clearly seen from FIG. 6, the curve part A in the circuit now discussed may now grow so that the triggering point is automatically advanced in a desired manner with increasing rpm. Remaining sequences are consequently not affected at all, and the circuit will otherwise function in the advantageous manner always provided by capacitive ignition circuits. The retardation burdening previously known systems is not present at all.

It is also possible to achieve rpm limitation with the circuit illustrated in FIG. 5. For example, if a given value is selected for the capacitor 12, the charge can be caused to remain for a time sufficiently long for the triggering function initiated by the curve part A to be inhibited also. This results in that the circuit can be set to limit the engine rpm very exactly, thus avoiding engine over-revolutions. In order to provide better control of the time constant, a leakage resistor can be arranged across the capacitor 12, or a time circuit of some kind can be arranged.

It is naturally not necessary within the scope of the invention for the trigger winding 10 to be short-circuited by the thyristor 15 or triac, and switching out the trigger winding during a particular time interval is also conceivable. Both the charge winding 1 and trigger winding 10 can be replaced by other voltage sources of equivalent functions.

I claim:

1. In a high reliability ignition system utilizing a minimum number of electrical components for controlling the triggering sequence in response to a rotating permanent magnet for internal combustion engines having a spark coil, and a core of magnetic conducting material carrying a capacitor charging coil, and an electrically separate triggering coil wired in reverse polarity to said charging coil and cooperating with the rotating permanent magnet for producing three generated halfwaves in sequence in said coils, the charging coil being connected in series with a rectifier, a charging capacitor, and the primary winding of said spark coil, and a discharge thyristor connected in series with the charging coil and the primary winding of the spark coil and having its input gate coupled across the triggering coil, the improvement comprising an actuating timing circuit having a series combination of a diode and timing capacitor connected across the charging coil;

a switching thyristor having its anode connected to one terminal of the triggering coil and having its input gate connected to the intersection of said diode and said timing capacitor, the cathodes of said switching and discharge thyristor being connected together to the opposite terminal of the triggering coil, so that the charging capacitor discharges its stored charge upon the conduction of the discharge thyristor, the second halfwave being used for charging the charging capacitor and actuating said timing circuit, so as to maintain the discharge thyristor inactive during the presence of the third halfwave, whereupon triggering occurs during the first generated voltage halfwave in the next voltage sequence, said diode of said actuating timing circuit, permitting the second halfwave to pass and charge said timing capacitor during the charging phase of the charging capacitor wherein the total number of electrical components of the ignition system is no more than seven components including two diodes, two capacitors and two thyristors or triacs, and wherein said electrical circuit utilizes no resistors for high efficiency.

* * * * *